US005080407A

United States Patent [19]

Evers

[11] Patent Number: 5,080,407

[45] Date of Patent: Jan. 14, 1992

[54] REMOVABLE LOCKING LEVER FOR A CASEMENT WINDOW

[75] Inventor: Robert S. Evers, Pella, Iowa

[73] Assignee: Rolscreen Company, Pella, Iowa

[21] Appl. No.: 613,996

[22] Filed: Nov. 15, 1990

[51] Int. Cl.[5] ..... E05C 3/14

[52] U.S. Cl. ..... 292/241; 16/114 R; 292/DIG. 27; 292/DIG. 33; 292/348

[58] Field of Search ..... 292/241, DIG. 27, DIG. 33, 292/240, 242, 336.3, 350, 348, 347; 16/114 R

[56] References Cited

U.S. PATENT DOCUMENTS

| | | | |
|---|---|---|---|
| 814,364 | 1/1907 | Wickwar | 292/347 |
| 2,784,995 | 3/1957 | Hawkins | 16/114 R |
| 3,039,837 | 6/1962 | Poe | 292/DIG. 30 |
| 4,059,298 | 11/1977 | Van Klompenburg | 292/199 |
| 4,429,910 | 2/1984 | Anderson | 292/199 |
| 4,610,472 | 9/1986 | Billingsley | 292/54 |
| 4,621,847 | 11/1986 | Paulson et al. | 292/241 |
| 4,674,777 | 6/1987 | Guelck | 292/DIG. 20 |
| 4,807,914 | 2/1989 | Fleming et al. | 292/240 |

FOREIGN PATENT DOCUMENTS

| | | | |
|---|---|---|---|
| 958536 | 2/1957 | Fed. Rep. of Germany | 292/240 |
| 858075 | 11/1940 | France | 292/350 |
| 643733 | 2/1964 | France | 292/336.3 |
| 342963 | 2/1931 | United Kingdom | 292/348 |

*Primary Examiner*—Gary L. Smith
*Assistant Examiner*—Darnell M. Boucher
*Attorney, Agent, or Firm*—Zarley, McKee, Thomte, Voorhees & Sease

[57] ABSTRACT

A casement window locking system includes a rotatable locking cam mounted in the frame jamb with a window catch access opening on one side and a locking lever access opening on the opposite side. The locking lever has a U-shaped inner end which embraces the locking cam when the two members are engaged and a tab on the locking cam engages a shoulder on the locking lever to prevent withdrawal of the locking lever until a tool is used to raise the locking cam when the tool is inserted through the catch opening. In an alternative embodiment, a spring clip may be placed on top of the locking cam and it includes a shoulder for engaging the shoulder on the locking lever. The removable locking lever makes it possible to install and finish the window without the locking lever and change locking levers to color coordinate with the room interior.

17 Claims, 4 Drawing Sheets 2
26
12
28
14
16
10
22
24

40
42
56
36
54
58
32
16
20
30
38
68

8
9
58
54
36
40
42
56
32
20
30
38
68
72
74
60
34
50
52
5
10
22
53

76
62
64
66

REMOVABLE LOCKING LEVER FOR A CASEMENT WINDOW

BACKGROUND OF THE INVENTION

Casement window locking systems are customarily riveted assemblies which are secured to the window frame jamb with screws in an exposed manner. The Rolscreen Company of Pella Iowa has used a one piece cam and handle locking system that is secured to and contained within the window frame jamb. A partially exposed locking system has been used wherein the handle was secured with a set screw to a splined stud attached to the concealed locking cam. Loosening of the set screw would allow accidental removal of the handle rendering the window unsafe if it was needed to open it in an emergency.

Whether the locking system is on the exterior of the frame jamb or contained within it, the handle or lever must be in place to operate the lock to hold the sash closed during building construction and finishing, including the finishing of the window.

A locking system is needed that will allow the installation of the exposed portions of the locking mechanism after finishing is completed. The locking system should provide for interchangeability of handles for purposes of color coordinating with interior room decorating at any time after the window is manufactured and installed.

SUMMARY OF THE INVENTION

A casement window locking mechanism is provided that includes essentially two parts. The first part is a rotatable cam which is mounted in the frame jamb and which engages a catch on the window when in its closed position. The frame jamb has oppositely disposed access openings to the locking cam. The catch on the window can extend into or is received in an outer access opening while the locking lever is received in the inwardly facing access opening. When the locking lever is in place, the locking cam is not visible through the inner access opening. A tab on the locking cam engages a shoulder on the locking lever to prevent removal of the locking lever. A spring on the locking cam yieldably maintains engagement between the tab and the shoulder. When the locking lever is inserted into the inner access opening, the locking tab is deflected inwardly and rides up a beveled surface whereupon it engages the shoulder locking the lever in place.

Disengagement of the locking lever from the locking cam is possible through operation of a tool such as a screwdriver which is placed under the locking cam or tab whereby it is moved out of engagement with the locking lever shoulder allowing removal of the locking lever. The spring may be a curved spring on the screw holding the cam to the frame jamb or a spring clip on top of the cam which has a tab on its outer end for engagement with the shoulder on the locking lever.

The locking mechanism of this invention allows for a simplified installation of the window including the finishing of the window frame with the locking lever removed. After the window has been fully installed and finished, the locking lever may be installed for operation of the locking mechanism. As the decorating of the interior of the room changes, the locking lever can be changed as desired to provide color coordinated window hardware. It is also seen that the window may be temporarily operated through the use of the installed locking lever during construction and then removed as construction work continues. It is important that the locking lever can only be removed when the window is in its opened position a only then is access possible to the cam opening in the frame jamb. Thus, the locking lever is always in place and ready for use when the window is closed assuring that for safety reasons there is never a time when the window can't be opened.

DESCRIPTION OF THE PREFERRED EMBODIMENT

Figures 1, 2, 3, 4:
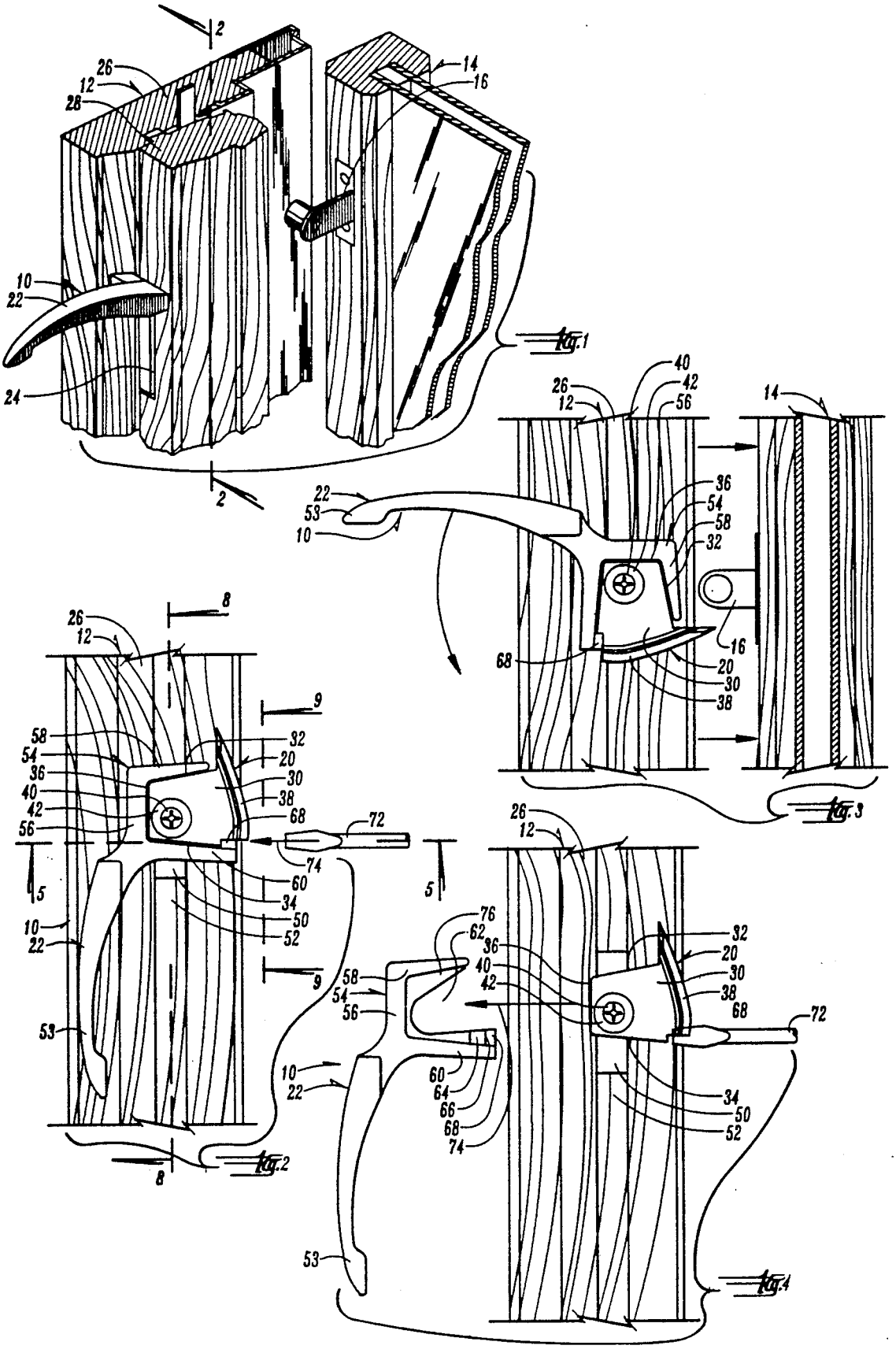
FIG. 1 is a fragmentary perspective view of the casement window locking mechanism installed in a frame jamb.
FIG. 2 is a fragmentary plan view taken along line 2—2 in FIG. 1 with a portion of the frame jamb being removed for illustrative purposes, showing the locking mechanism with the locking lever engaged to the locking cam.
FIG. 3 is a view similar to FIG. 2 but showing the window in position to be closed by the locking mechanism.
FIG. 4 is a view similar to FIG. 2, but illustrating the locking lever being disengaged from the locking cam by operation of a screwdriver tool.
Figure 9:
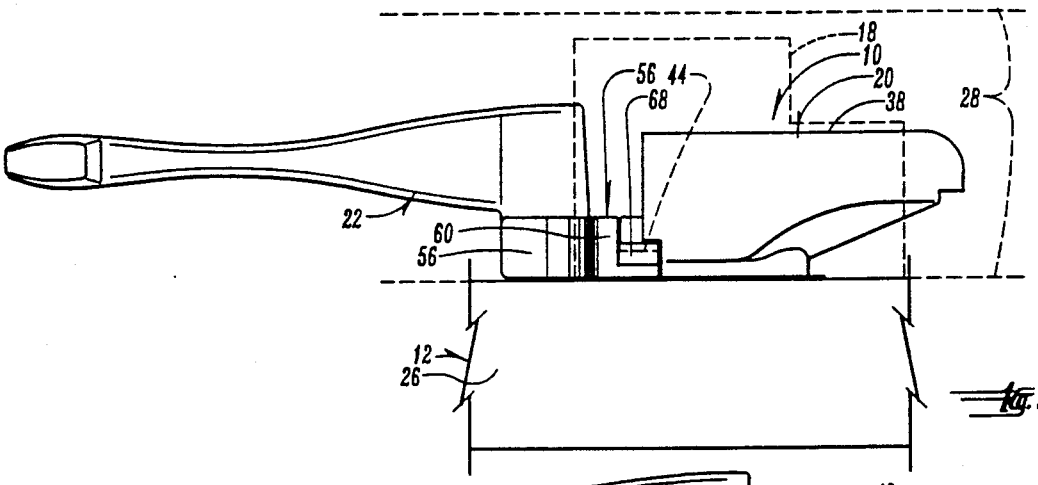
FIG. 9 is a cross sectional view taken along line 9—9 in FIG. 2.
Figure 11:
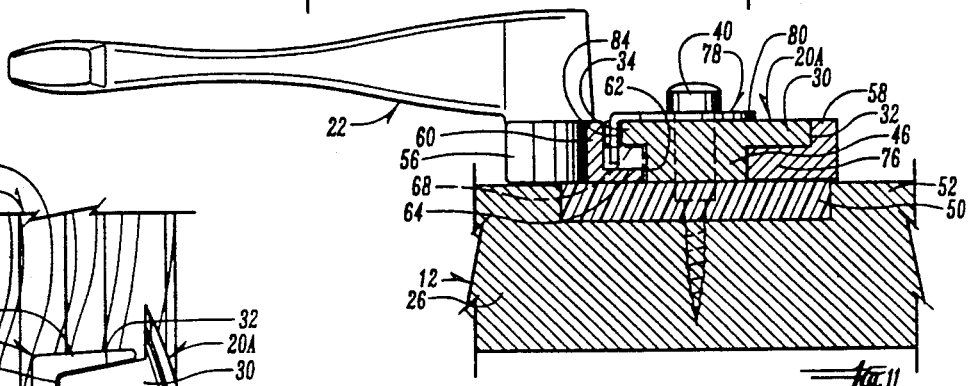
FIG. 11 is a cross sectional view taken along line 11—11 in FIG. 12.
Figure 10:
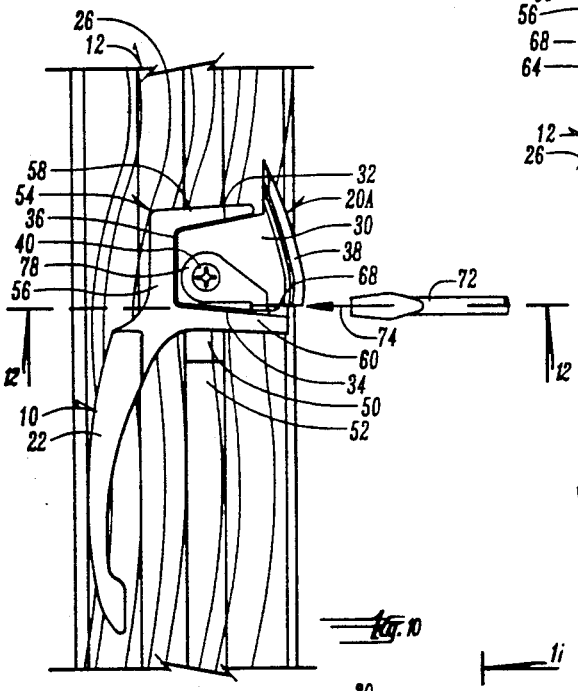
FIG. 10 is a fragmentary plan view of an alternate embodiment of the assembled locking mechanism wherein a spring clip is positioned on the cam.
Figure 13:
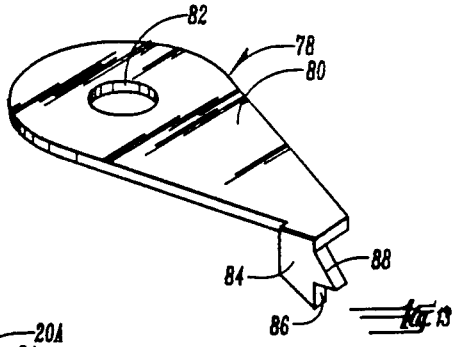
FIG. 13 is a perspective view of the spring clip.
Figure 12:
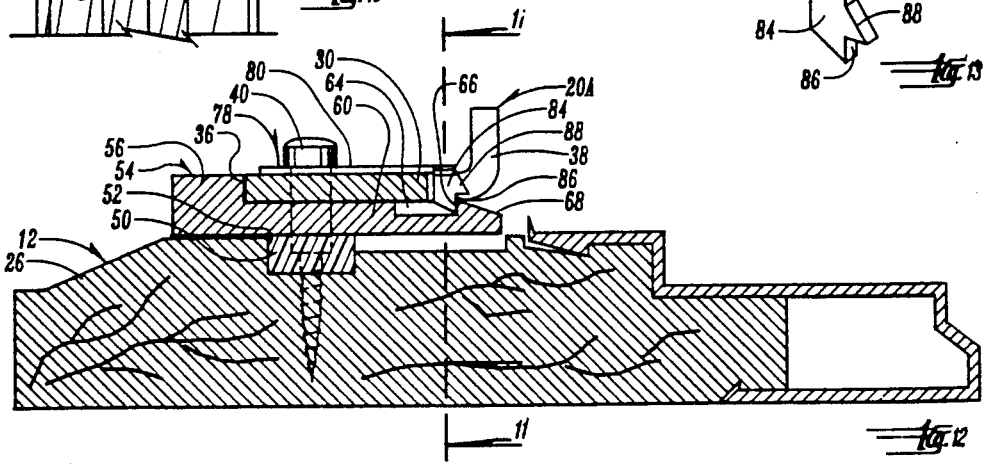
FIG. 12 is a cross sectional view taken along line 12—12 in FIG. 10.

The casement window locking system of this invention is referred to generally in FIG. 1 by the reference numeral 10 and is shown mounted in the window frame jamb 12. A casement window 14 is hinged on the opposite window frame jamb (not shown) allowing a catch 16 to be received in an exterior or outer access opening 18 as seen in FIG. 9 for engagement by a cam 20 which may be rotated by a locking lever 22. The locking lever 22 is received in an interior access opening 24 in the window frame jamb 12. The window frame jamb 12 includes an outer portion 26 and an inner portion 28 which provide containment for the locking cam 20 leaving only portions of the locking lever 22 exposed through the interior access opening 24 when the locking lever is installed as seen in FIG. 1.

Figure 5:
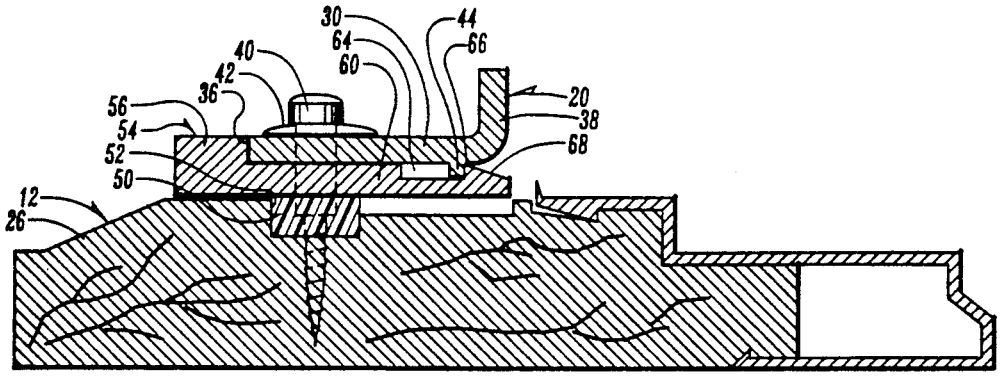
FIG. 5 is a cross sectional view taken along line 5—5 in FIG. 2.

The locking cam 20 includes a base portion 30 having opposite sides 32 and 34 and an end edge 36 opposite a cam portion 38 engageable with the sash catch 16. A screw 40 extends through a curved spring washer 42 which presses on the top of the cam 20 for maintaining engagement with the locking lever 22 as hereinafter described. Screw 40 is anchored in the outer frame jamb portion 26. As seen in FIG. 5, an outwardly extending tab 44 extends in the opposite direction from the cam portion 38.

Figure 8:
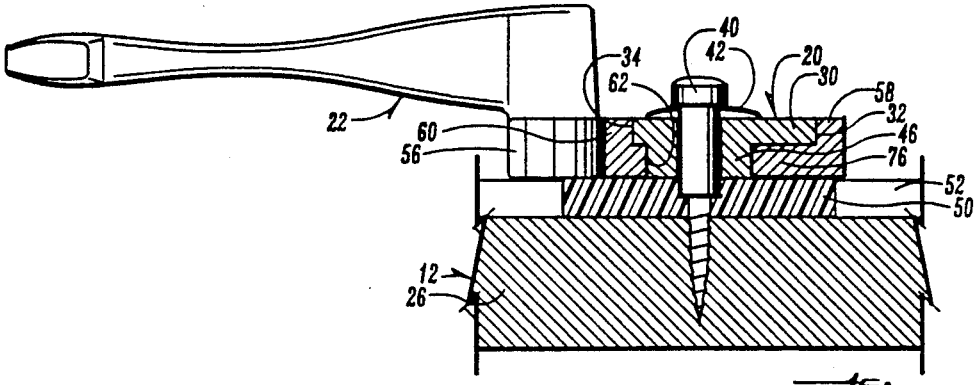
FIG. 8 is a cross sectional view taken along line 8—8 in FIG. 2.

Referring to FIG. 8, it is seen that the locking cam 20 has a center body portion 46 with outwardly extending wings or edges 32 and 34. The center body portion 46 is supported on a spacer 50 received in a channel 52 in the outer portion 26 of the window frame jamb 12.

The locking lever 22 includes an outer end handle portion 53 and an inner end 54 which is U-shaped and includes a base portion 56 with oppositely disposed legs 58 and 60 defining a slot 62. A channel 64 is formed in the leg 60 and includes a shoulder 66. The legs 58 and 60 are spaced to matingly engage the side edges 32 and 34 of the locking cam 20 while the edge 36 engages the base portion 56. When assembled, the shoulder 66 is below the tab 44. Tab 44 is positioned to engage an outwardly tapering portion or surface 68 and continued movement of the locking lever 22 towards the cam 20 causes the tab 44 to drop into the channel 64 locking it against the shoulder 66. The curved spring 42 on the screw 40 maintains the engagement of tab 44 with shoulder 66.

Figure 6:
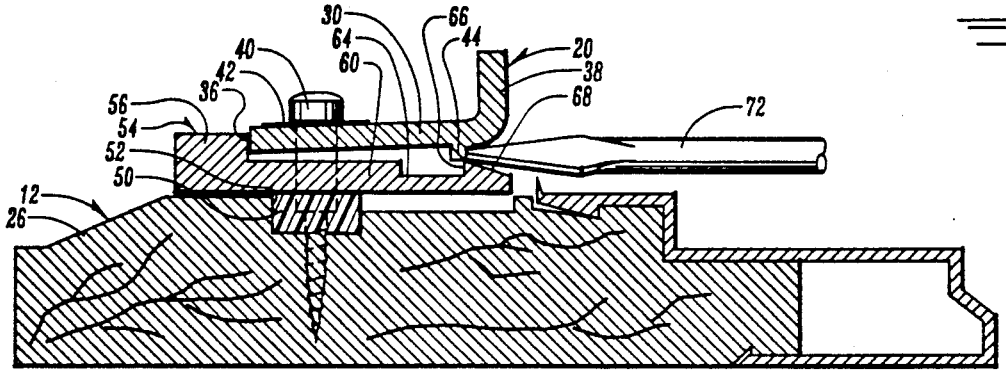
FIG. 6 is a view similar to FIG. 5, but showing the use of a screwdriver tool to disengage the locking cam from the locking lever.
Figure 7:
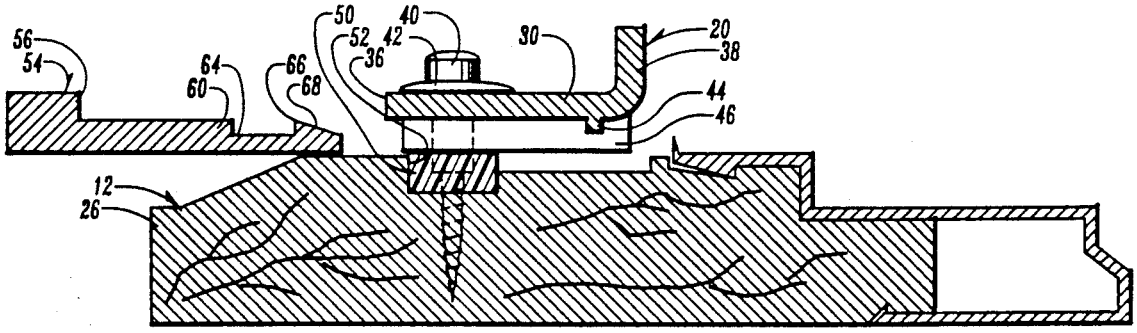
FIG. 7 is a view similar to FIG. 6, but showing the locking lever disengaged and removed.

As seen in FIG. 6, a screwdriver 72 may be inserted under the cam portion 38 and on top of the tapered portion 68 whereby twisting of the screwdriver will raise the locking cam 20 thereby disengaging the tab 44 from the shoulder 66 and allowing the locking lever 22 to be moved in the direction of the arrow 74 in FIG. 4.

In FIGS. 4 and 8, it is seen that a flange portion 76 on the legs 58 and 60 and the base portion 56 extend under the wings or edges 32 and 34 and end edge 36 of the cam 20 to provide an embracing nesting relationship between the locking lever 22 and the cam 20.

Figure 14:
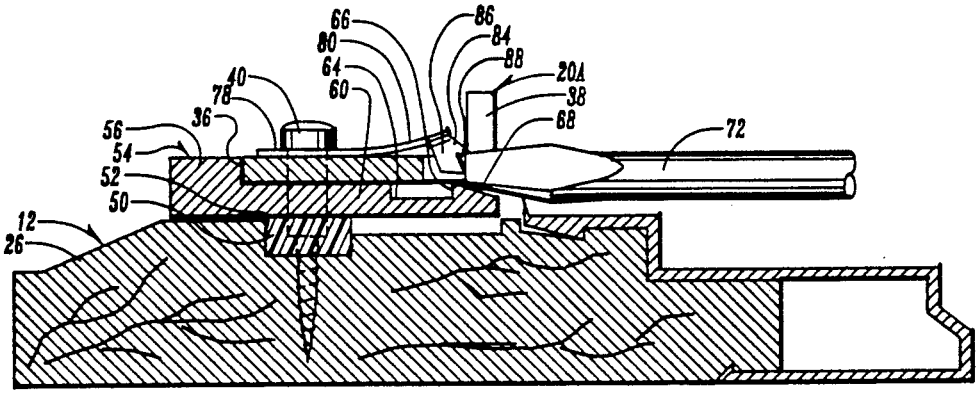
FIG. 14 is a view similar to FIG. 12, but showing the spring clip being disengaged from the locking lever.
Figure 15:
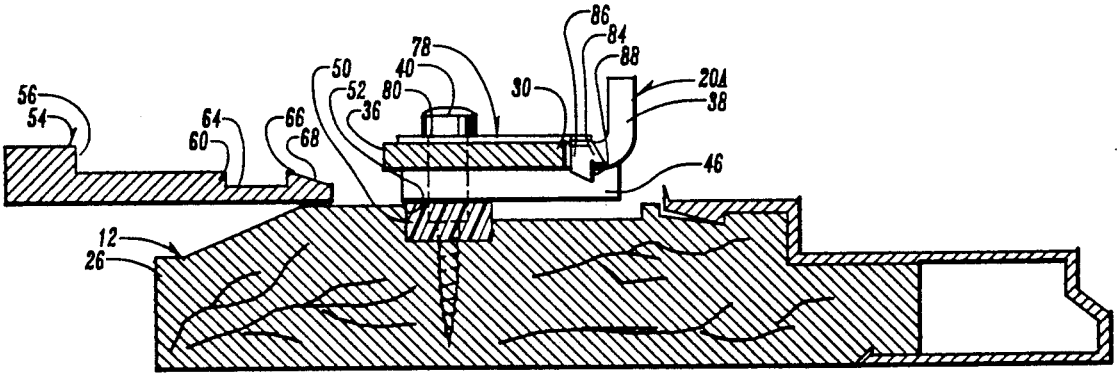
FIG. 15 is a view similar to FIG. 14, but showing the disengagement of the spring clip completed and the locking lever removed.

In FIGS. 10–15, an alternate embodiment is shown wherein a spring clip 78 is substituted for the curved spring washer 42. The clip 78 includes a plate element 80 having a hole 82 for being mounted on the screw 40 on top of the locking cam 20*a*. A perpendicularly extending tab 84 on the clip 78 includes right angle shoulders 86 and 88 with the shoulder 86 positioned to engage the shoulder 66 on the locking lever 22 and the shoulder 88 positioned to engage a screwdriver 72 as seen in FIG. 14. Thus it is seen in operation that the locking lever 22 is assembled with the locking cam 20 in the same manner as it was in connection with the embodiment of FIGS. 1–9, except that the shoulder 86 on the spring clip 78 replaces the tab 44 on the locking cam 20 in engagement with the shoulder 66 on the locking lever 22. In disengaging the locking lever 22 from the locking cam 20, the screwdriver is placed under the shoulder 88 on the spring clip 78 rather than under the cam portion 38 of the cam 20. The embodiment of FIGS. 1–9 is simplified by the elimination of one component, i.e. the special spring clip 78.

I claim:

1. The combination of a window and locking device, the window having a frame including a jamb, and a sash having interior and exterior sides, said sash being hinged to said frame and being moveable between open and closed positions, a locking device comprising:

a catch on the interior side of said sash, a cam rotatably mounted in said jamb for locking engagement with said catch when said sash is in said closed position, a locking lever removably attached to said cam for rotating said cam between locked and unlocked positions, said jamb including oppositely facing interior and exterior access openings with said catch being received in said exterior access opening and said locking lever being received in said interior access opening, cooperating locking means on said locking lever and said cam, and said locking lever including oppositely disposed inner and outer ends with said inner end being received in said interior access opening, and said inner end being U-shaped, said U-shape being defined by a pair of spaced apart legs interconnected by a base portion forming a slot and said cam being received in said slot between said legs.

2. The structure of claim 1 wherein said cooperating locking means are accessible through said exterior access opening for disengaging said locking lever from said cam for removal of said locking lever.

3. The structure of claim 2 wherein said locking lever when received in said interior access opening substantially conceals said cam from view through said interior access opening.

4. The structure of claim 1 wherein said pair of legs and base portion limit relative movement of said locking lever and said cam in three directions and said cooperating locking means limits relative movement in a fourth direction.

5. The structure of claim 1 wherein said cooperating locking means limit removal of said locking lever from said interior access opening.

6. The structure of claim 4 wherein said cooperating locking means limit removal of said locking lever from said interior access opening when limiting relative movement in said fourth direction.

7. The structure of claim 2 wherein said locking means on said locking lever is further defined as including an outwardly tapering portion which terminates in an inwardly extending shoulder, and said locking means on said cam operatively includes an inwardly extending tab engageable with said outwardly tapering portion when said lever is being moved into engagement with said cam followed by later engagement by said shoulder to limit disengagement of said locking lever with said cam.

8. The structure of claim 7 wherein said tab engagement with said outwardly tapering portion displaces said cam in opposition to said spring means and said spring means yieldably holds said tab in engagement with said shoulder.

9. The structure of claim 8 wherein said spring means is further defined as a curved washer on a screw extending through said cam with said washer pressing outwardly on said cam.

10. The structure of claim 8 wherein said spring means is further defined as being a spring clip on said cam, and said clip includes said outwardly extending tab, which is yieldably deflected inwardly as said tapered portion is moved into engagement with said tab when said lever is being moved into engagement with said cam.

11. The structure of claim 10 wherein said spring clip includes an inwardly facing shoulder adapted to be engaged by a tool for disengaging said tab from said inwardly facing shoulder on said locking lever by said clip being deflected inwardly.

12. The combination of a window and locking device, the window having a frame including a jamb, and a sash having interior and exterior sides, said sash being hinged to said frame and being moveable between open and closed positions, a locking device comprising:

a catch on the interior side of said sash, a cam rotatably mounted in said jamb for locking engagement with said catch when said sash is in said closed position, a locking lever removably attached to said cam for rotating said cam between locked and unlocked positions, said jamb including oppositely facing interior and exterior access openings with said catch being received in said exterior access opening and said locking lever being received in said interior access opening, cooperating locking means on said locking lever and said cam, and said locking lever including oppositely disposed inner and outer ends with said inner end being received in said interior access opening, said cooperating locking means are in alignment when said inner end is received in said interior access opening, and spring means operatively allows said cooperating lock means on said locking lever to move past said locking means on said cam when said locking lever is being received in said interior access opening, and said cooperating locking means limits removal of said locking lever from said interior access opening and limits movement relative to said cam in a direction opposite to that when said lever is being received in said interior access opening.

13. The combination of a window and locking device, the window having a frame including a jamb, and a sash having interior and exterior sides, said sash being hinged to said frame and being moveable between open and closed positions, a locking device comprising:

a catch on the interior side of said sash, a cam rotatably mounted in said jamb for locking engagement with said catch when said sash is in said closed position, a locking lever removably attached to said cam for rotating said cam between locked and unlocked positions, said jamb including oppositely facing interior and exterior access openings with said cam being exposed in said exterior access openings and said locking lever being received in said interior access opening, and said cam in said jamb being disposed sufficiently towards said exterior access opening and remote to said interior access opening that said cam is substantially hidden from view outwardly of said interior access opening.

14. The structure of claim 13 wherein said cooperating locking means accessible through said exterior access opening are only accessible when said cam is rotated to said locked position with said sash in said open position.

15. The combination of a window and locking device, the window having a frame including a jamb, and a sash having interior and exterior sides, said sash being hinged to said frame and being moveable between open and closed positions, a locking device comprising:

a catch on the interior side of said sash, a cam rotatably mounted in said jamb for locking engagement with said catch when said sash is in said closed position, a locking lever removably attached to said cam for rotating said cam between locked and unlocked positions, said jamb including oppositely facing interior and exterior access openings with said catch being exposed in said exterior access openings and said locking lever being received in said interior access opening, cooperating lock means on said cam and said locking lever to yieldably interconnect said cam and locking lever; and said cooperating lock means being accessible and operable only through said exterior access opening whereby said locking lever may be disconnected from said cam only when said sash is in said open position giving access to said cooperating lock means through said exterior access opening.

16. A locking device for a casement window, comprising, a cam adapted to be rotatably mounted in a jamb for locking engagement with a catch on a sash when said sash is in a closed position, a locking lever removably attached to said cam for rotating said cam between locked and unlocked positions, cooperating locking means on said locking lever and said cam, and said locking lever including oppositely disposed inner and outer ends with said inner end being U-shaped, said U-shape being defined by a pair of spaced apart legs interconnected by a base portion forming a slot and said cam being received in said slot between said legs.

17. A locking device for a casement window, comprising, a cam rotatably adapted to be mounted in a jamb for locking engagement with a catch on a sash when said sash is in a closed position, a locking lever removably attached to said cam for rotating said cam between locked and unlocked positions, cooperating locking means on said locking lever and said cam, and said locking lever including oppositely disposed inner, said cooperating locking means on the locking lever biases a outer ends to spring means to thereby operatively allow said cooperating lock means on said locking lever to move past said locking means on said cam when said locking lever is being engaged by said cam, and said cooperating locking means limiting movement relative to said cam in a direction opposite to that when said lever is being engaged by said cam.

* * * * *